United States Patent [19]

Stuck

[11] 4,280,314

[45] Jul. 28, 1981

[54] DEVICE FOR PACKAGING ELONGATED ARTICLES

[75] Inventor: Matthew A. Stuck, Menasha, Wis.

[73] Assignee: Modern Mfg. Co., Inc., Menasha, Wis.

[21] Appl. No.: 73,536

[22] Filed: Sep. 7, 1979

[51] Int. Cl.[3] ..... B65B 67/02; B65B 67/04

[52] U.S. Cl. ..... 53/241; 53/390

[58] Field of Search ..... 53/390, 567, 570, 571, 53/576, 592, 585, 241, 250, 256; 248/97, 99, 100

[56] References Cited

U.S. PATENT DOCUMENTS

| | | | |
|---|---|---|---|
| 1,183,454 | 5/1916 | Hayashi | 53/241 |
| 2,160,245 | 5/1939 | Wood | 53/241 |
| 2,590,742 | 3/1952 | Williams | 53/390 X |
| 2,971,312 | 2/1961 | Bell, Jr. | 53/390 |

FOREIGN PATENT DOCUMENTS

| | | | |
|---|---|---|---|
| 2107006 | 9/1971 | Fed. Rep. of Germany | 53/390 |
| 1244932 | 9/1960 | France | 53/390 |
| 587067 | 1/1959 | Italy | 53/390 |

*Primary Examiner*—Horace M. Culver

*Attorney, Agent, or Firm*—Andrus, Sceales, Starke & Sawall

[57] ABSTRACT

A device for packaging elongated articles, such as plants and cut flowers, in a protective bag. The device includes a tubular frame having a generally horizontal section and a vertical section which is connected to one end of the horizontal section. A support is carried by the upper end of the vertical section and is adapted to support a plant to be packaged. One or more elongated open ended bags are initially positioned around the horizontal section of the frame, and the bag is then drawn upwardly around the plant that is supported on the support to package the plant.

4 Claims, 3 Drawing Figures

DEVICE FOR PACKAGING ELONGATED ARTICLES

BACKGROUND OF THE INVENTION

It is often desired to enclose a plant or cut flowers in a protective plastic or paper bag to protect the plant against extreme temperatures. The U.S. Pat. No. 3,431,706 describes a device for bagging or packing small plants in protective plastic bags. The device shown in the aforementioned patent is not particularly suitable for bagging plants of substantial height, in the range of about 4–6 ft. and generally bagging of taller plants has been a manual operation.

Bagging of taller sized plants has normally required the service of two persons. One person holds the bag open and the second person lifts the plant above the open-ended bag and then lowers it into the bag. The person holding the bag then attempts to catch the plant as it is lowered within the bag. Not only does this method of bagging require the services of two persons, but in many cases the plant may fall within the bag, with the result that it is damaged.

SUMMARY OF THE INVENTION

The invention relates to a device for packaging or bagging articles of substantial height, such as plants or cut flowers. In accordance with the invention, the device includes a tubular frame, composed of a generally horizontal section and a vertical section which extends upwardly from one end of the horizontal section and terminates in a supporting surface or platform which is adapted to hold the plant or other article to be bagged.

An elongated open-ended bag is positioned around the horizontal section of the frame and the bag is then drawn upwardly around the plant that is supported on the platform. When the bag has been drawn completely around the plant, the upper end of the bag can be closed, as by stapling, and the plant is then removed from the platform and the lower open end of the bag can also be closed off to provide a complete enclosure or package for the plant.

With the device of the invention, taller plants or cut flowers can be packaged by a single person. Moreover, the plant is supported adjacent the ground and the bag can be drawn over the plant by the operator standing on the ground without the need of a ladder.

The device is lightweight and portable and can be readily moved from location to location in the floral shop or nursery.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
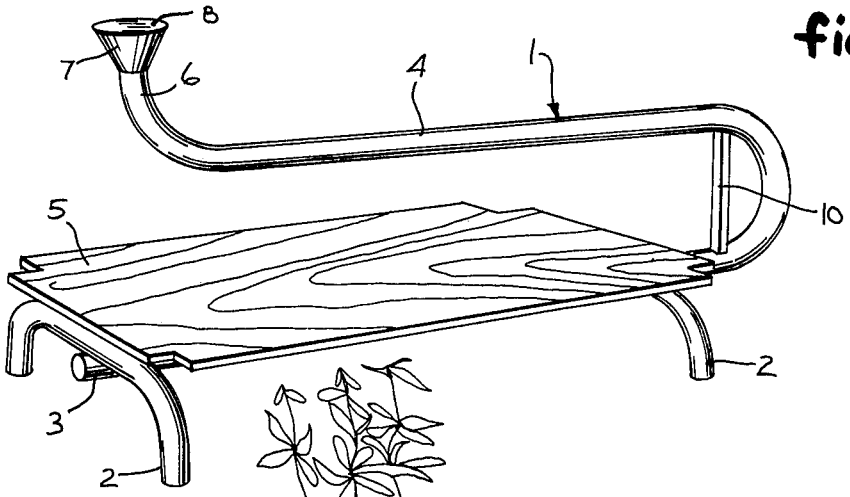
FIG. 1 is a perspective view of the device of the invention prior to the bagging or packaging operation.
Figure 2:
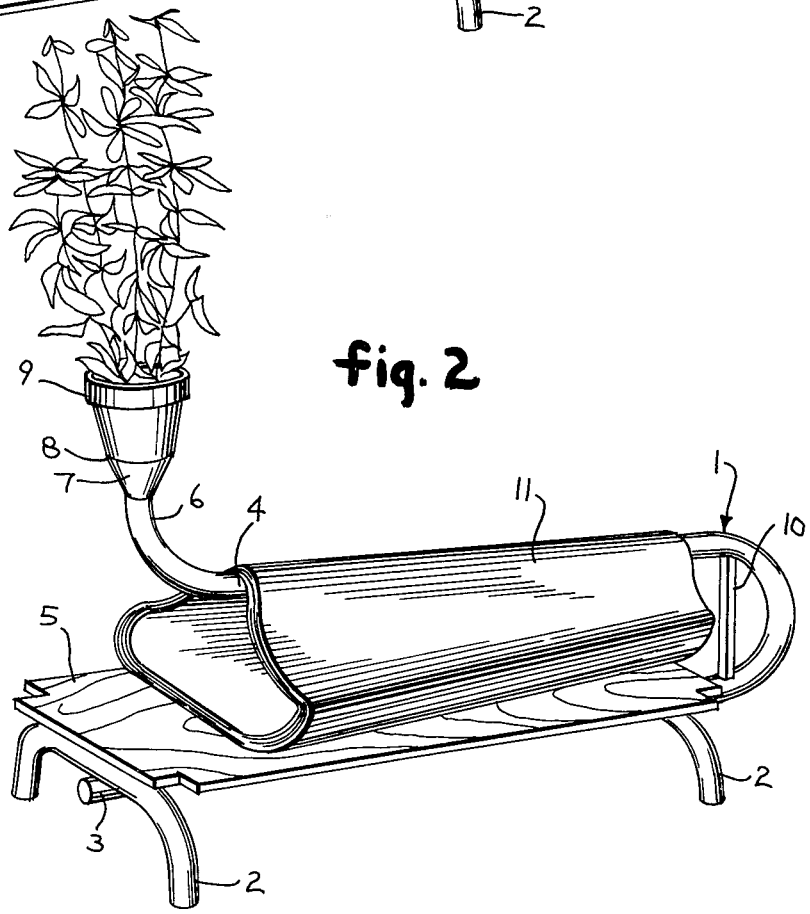
FIG. 2 is a perspective view similar to FIG. 1, showing the bags disposed around the horizontal section of the frame and the plant supported on the platform.

The drawings illustrate a device for packaging or bagging articles of substantial height, such as plants, cut flowers, and shrubs. The device includes a tubular frame 1 which is supported from the ground or foundation by a pair of generally U-shaped legs 2.

The frame 1 includes a lower, generally horizontal section 3 which is connected to the legs 2 and an upper horizontal section 4, which is spaced above section 3 and is connected to the lower section by a reverse bend. A generally horizontal board or plate 5 formed of plywood, sheet metal, plastic, or the like, is mounted on the lower section 3 of the frame.

As shown in FIG. 1, the end of the upper horizontal section 4 terminates in a generally vertical section 6 and the upper end of vertical section 6 flares outwardly, as indicated by 7, and defines a platform or supporting surface 8 for the plant 9 or other article to be packaged. As shown in FIG. 1, a vertical brace 10 can be connected between the horizontal sections 3 and 4 to provide added rigidity for the frame.

One or more open-ended bags 11 formed of plastic or paper surround the upper horizontal section 4 and are supported on the surface 5. In practice, where a substantial number of plants may be bagged, a number of bags 11 may be nested together and supported on surface 5. The bags are tapered in a longitudinal direction and the side edges are glued or otherwise connected to provide an open-ended construction in which the end of the bag located adjacent the vertical section 6 has an opening of substantially greater area than the opposite open end of the bag.

Figure 3:
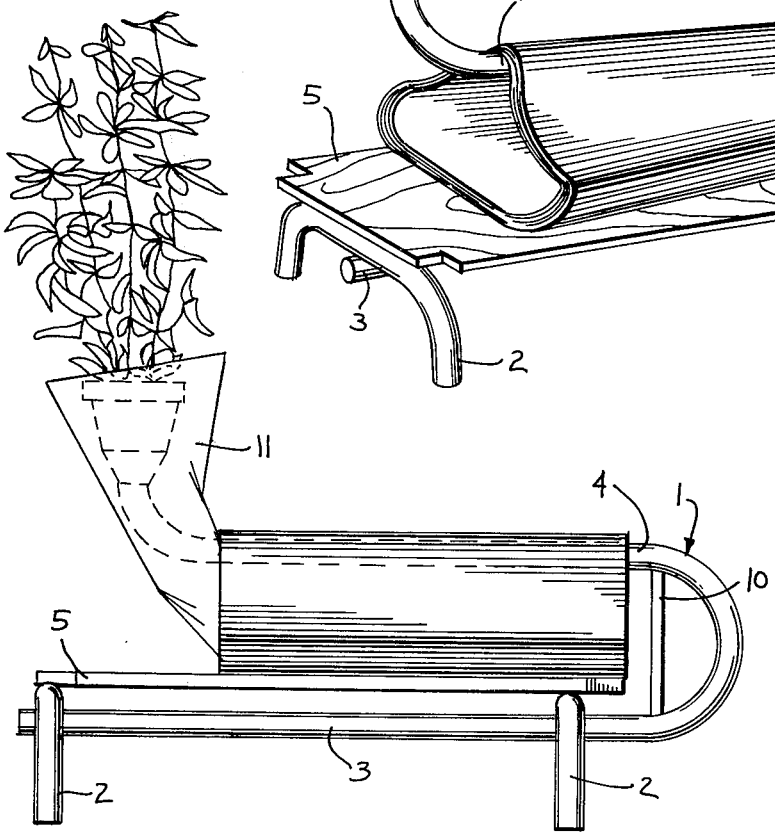
FIG. 3 is a side elevation of the device showing the plant partially packaged.

In operation, the plant is positioned on the platform or supporting surface 8 and one of the nested bags 11 resting on the surface 5 is drawn upwardly around the plant 9, as illustrated in FIG. 3. The upwardly diverging section 7 prevents the bag from snagging as it is drawn upwardly around the plant. When the upper end of the bag fully encloses the plant 9, the operator can close off the upper end of the bag by stapling. The plant 9 and the enclosing bag 11 is then removed from the platform and the lower open end of the bag can then also be closed off by stapling or the like.

The device of the invention is of simple construction and enables a single operator to package or bag articles of substantial height, up to about 6 ft. in height. As the platform 8 which supports the plant is located only slightly above the ground, the operator can draw the bag upwardly around the plant and enclose the upper end of the bag without the necessity of utilizing a step ladder or stool.

The device is of lightweight construction and can readily be moved from location to location in the floral shop or nursery.

While the description has shown the device of the invention being used to bag or package a plant, the device can be used to package various types of elongated articles.

Various modes of carrying out the invention are contemplated as being within the scope of the following claims particularly pointing out and distinctly claiming the subject matter which is regarded as the invention.

I claim:

1. A device for packaging plants in protective bags, comprising a tubular frame including a first generally horizontal section having a forward end, said frame also including a generally vertical section connected to the forward end of said horizontal section, a plant support mounted on the upper extremity of the vertical section and located at a level above the horizontal section, said support adapted to support a plant to be packaged, a bag support platform disposed beneath and generally parallel to said horizontal section, said platform extending laterally to either side of a vertical plane passing through said horizontal section and extending forwardly beyond the forward end of said horizontal section, and a plurality of nested open-ended bags disposed around said horizontal section and freely resting on said supporting surface, said bags being individually drawn upward around said vertical section and around said plant supported on the support to thereby package the plant.

2. A device for packaging elongated articles in protective bags, comprising a tubular frame including a generally horizontal section and a generally vertical section connected to one end of said horizontal section, a support mounted on the upper extremity of the vertical section and defining a platform to support the article to be packaged, a bag support member having a supporting surface spaced beneath said horizontal section, said supporting surface extending laterally to either side of a vertical plane passing through said horizontal section, and a plurality of nested open-ended bags disposed around said horizontal section and resting on said supporting surface, said bags being individually drawn upwardly around the article being supported on said platform to thereby package the article.

3. The device of claim 2, wherein said frame includes a second generally horizontal section spaced beneath said first horizontal section, said bag support member being mounted on said second horizontal section.

4. The device of claim 2, wherein said frame includes an upwardly diverging section connecting the upper extremity of the vertical section and said support.

* * * * *